US005778943A

United States Patent [19]

Tholander

[11] Patent Number: 5,778,943

[45] Date of Patent: Jul. 14, 1998

[54] CONTROLLABLE OUTPUT BRAKE, THREAD FEED DEVICE AS WELL AS PROJECTILE OR GRIPPER WEAVING MACHINE

[75] Inventor: Lars Helge Gottfrid Tholander, Ulricehamn, Sweden

[73] Assignee: IRO AB, Ulricehamn, Sweden

[21] Appl. No.: 682,752

[22] PCT Filed: Jan. 26, 1995

[86] PCT No.: PCT/EP95/00284

§ 371 Date: Jul. 25, 1996

§ 102(e) Date: Jul. 25, 1996

[87] PCT Pub. No.: WO95/20700

PCT Pub. Date: Aug. 3, 1995

[30] Foreign Application Priority Data

Jan. 26, 1994 [SE] Sweden ..... 9400248
Jul. 15, 1994 [SE] Sweden ..... 9400248

[51] Int. Cl.[6] ..... D03D 51/00

[52] U.S. Cl. ..... 139/452; 242/47.01; 139/446

[58] Field of Search ..... 139/452, 446; 242/47.01

[56] References Cited

U.S. PATENT DOCUMENTS

| | | | |
|---|---|---|---|
| 5,343,899 | 9/1994 | Jacobsson et al. | 139/452 |
| 5,409,043 | 4/1995 | Zeonoi et al. | 242/47.01 |
| 5,509,450 | 4/1996 | Tholander | 139/452 |
| 5,546,994 | 8/1996 | Sarfati | 139/452 |
| 5,553,641 | 9/1996 | Zenoni | 139/452 |

FOREIGN PATENT DOCUMENTS

| | | |
|---|---|---|
| 0 246 182 A1 | 11/1987 | European Pat. Off. . |
| 0 536 088 A1 | 4/1993 | European Pat. Off. . |
| 0 567 045 A1 | 10/1993 | European Pat. Off. . |
| 1 355 518 | 5/1971 | United Kingdom . |
| WO 91/14032 | 9/1991 | WIPO . |

*Primary Examiner*—Andy Falik
*Attorney, Agent, or Firm*—Flynn, Thiel, Boutell & Tanis, P.C.

[57] ABSTRACT

A controllable output brake for a thread feed device includes actuating elements that are connected to a control member and are used for effecting a controlled displacement of a thread brake element. The controlled displacement is an axial play with which a supporting ring for the thread brake element is supported in a holding member. The controlled displacement is used for controlling the tension of a thread. In the case of such a thread feed device, a push drive connected to the holding member is provided for each direction of movement in which the thread brake element is adjusted. The push drive for at least one direction of movement is a pneumatic push drive connected to a pneumatic drive control unit. In a projectile weaving machine, the controlled output brake is disengaged and re-engaged approximately in synchronism with a controlled thread brake which is provided as well. The engagement is preferably carried out in advance of the engagement of the controlled thread brake. In a gripper weaving machine, the controlled output brake is disengaged and re-engaged several times during each picking operation.

15 Claims, 5 Drawing Sheets

CONTROLLABLE OUTPUT BRAKE, THREAD FEED DEVICE AS WELL AS PROJECTILE OR GRIPPER WEAVING MACHINE

FIELD OF THE INVENTION

The present invention refers to a controllable output brake in a thread feed device for projectile or gripper weaving machines, as well as a projectile weaving machine and a gripper weaving machine having such a controllable output brake.

DESCRIPTION OF THE RELATED ART

A controllable output brake on the storage drum of a thread feed device is known for projectile or gripper weaving machines for limiting the balloon during the picking operation and for permitting thread control. The load applied by the output brake to the outgoing thread at the beginning of the picking operation should be very small, especially with regard to the dreaded sudden stretching and with regard to the use of sensitive thread qualities, which may perhaps be of poor quality, and the thread tension should only be increased in the course of the picking operation. This, however, necessitates exactly reproducable and fast responding changes in the braking effect, i.e. changes within a few milliseconds. In the case of the high thread speeds normally used in modern weaving machines of this type, these requirements cannot be met in a satisfactory manner by the output brakes which have been known for more than 20 years.

One example is the output brake according to U.S. Pat. No. 3,411,548 in the case of which guide members projecting outwards from the supporting ring engage oblique slots of the crescent-shaped holding member. The displacement drive is provided with a cam drive for rotating the supporting ring about the drum axis and relative to the holding member. In the course of the rotational movement, the supporting ring is moved forwards or backwards over the slots, depending on the direction of rotation, for varying the braking effect during operation. Comparatively big masses which have to be moved rapidly, energy-consuming rerouting of movements, instable end positions of the supporting ring, etc. are the reasons in view of which this principle, which has been known for a long time, is not used in connection with modern weaving machines.

Another output brake is known from GB-A-13 55 518 for a projectile weaving machine. A rigid balloon limiting cone is adapted to be moved to and fro in the stationary holding member between a position where light braking is effected and an open gap position. The cone has secured thereto an annular armature of a magnetic drive, which, when the coil is acted upon by current, draws the cone against a restoring spring from said gap position into the braking position. Large masses which are to be moved, a comparatively coarsely starting and slowly finishing braking effect and a delayed response behaviour are the reasons for the fact that this output brake is no longer used in modern weaving machines of this type.

A modern controllable output brake is known from FIG. 6 and 7 of WO91/14032. The frusto-conical supporting ring is tiltably supported in the inner circumferential surface of the annular holding member about a line which is defined by openings and webs and which is concentric with the axis of the storage drum. In the tilting area, the supporting ring is secured in position in the holding member without an amount of axial play which would be worth mentioning. In both tilting directions about the tilting line, the amount of space provided for the supporting ring in the holding member exceeds the amount of space that would be necessary for adjusting said supporting ring. The free inner end portion of the thread brake element rests on the brake surface of the storage drum and is acted upon by an actuating element which is located in said holding member behind the supporting ring, said actuating element being e.g. an inflatable and deflatable hose extending in said holding member in the circumferential direction. The hose is adapted to be filled via the drive control unit with a larger or smaller amount of pressurized air or of some other medium, and, via the tilting position of the supporting ring, it determines the magnitude of the contact pressure on the brake surface. The resetting of the supporting ring for the purpose of reducing the contact pressure is effected through the elasticity of the thread brake element itself because the actuating element has only one direction of operation. Due to the frusto-conical shape of the supporting ring, the tilting of the supporting ring necessitates a deformation of the truncated cone, which has comparatively good shape-retaining properties, and, consequently, very high actuating forces on the part of the actuating member. Hence, an inputted increase in the contact pressure will become effective only with delay and the degree of said increase can hardly be predetermined precisely. When the contact pressure is reduced, the supporting ring will displace the medium from the actuating element. In view of the fact that the tilting position of the supporting ring can be adjusted by means of the pressure in the elastic actuating element and in view of the fact that limiting stops for the supporting ring are not provided, precisely reproducable tilting positions are not possible. The requirements with regard to precise thread control cannot be fulfilled in a satisfactory manner by means of this output brake.

In the case of a controlled thread brake known from EP-A-246 182, FIG. 2, 3, elastic metal fingers are pressed by means of magnets against the storage drum of the thread feed device. When the magnets have been de-energized, the metal fingers return automatically to a non-braking position. The thread brake serves to stop the thread completely so that the length of the inserted weft thread can be dimensioned for each picking operation. This thread brake is not provided for varying the braking effect for the weft thread of a projectile or gripper weaving machine. It would be too slow in the-direction of release because the velocity with which and the extent to which the thread brake is released depends on the elasticity of the metal fingers.

It is the object of the present invention to provide a controllable output brake and a projectile as well as a gripper weaving machine with a simple structural design of such a nature that precise weft thread control is given even in the case of high thread speeds, and to guarantee that the controllable output brake permits even in the case of delicate qualities of threads the use of the high thread speeds that are possible in modern weaving machines of these types.

SUMMARY OF THE INVENTION

This object is achieved by the features of the output brake discussed hereinafter.

For displacing the supporting ring or the elastic central portion of the thread brake element in the respective direction of movement up to the opposite contact area or stop, it will suffice to move only small masses along very short distances without energy-consuming rerouting being necessary. With the aid of the pressurized air medium and the push drives provided for each direction of movement, this will result in an exactly reproducable, precisely controllable and rapid response so that the output brake can, for example, be disengaged and re-engaged in a few milliseconds, e.g. 15 milliseconds. The pressurized air provides high operational reliability and produces comparatively strong forces for positioning the supporting ring and the deformable central portion at the respective position. Pressurized air is available in the thread feed device and in the weaving machine, respectively, it is ecologically desirable and efficient. The fast response is advantageous because the output brake is disengaged a very short time before the picking operation is started, i.e. the thread is not released too early, and because, during the picking operation, it can be engaged rapidly and, if necessary, immediately be disengaged again, whereby precise adaptation to the transfer phase will be obtained in gripper weaving machines and delays of the flight of the projectile (no deviation from the predetermined time of arrival) will be avoided in projectile weaving machines. Surprisingly enough, the hitherto unavoidable tension peak of sudden stretching in the thread occurring in the initial phase of the picking operation can be minimized or eliminated even in the case of high thread speeds, whereby the thread breakage rate will be reduced extremely. The efficiency of modern weaving machines of these types can be utilized fully even if sensitive and less expensive thread qualities are used. Exact positioning is achieved at both end positions of the push drives. The displacement drives only have the function of displacing, within the shortest possible time, the supporting ring and the elastic central portion of the thread brake element from one position to another and of positioning them there.

A piston acted upon via the pneumatic drive control unit will operate reliably even for long periods of use and many operating cycles. The permanently active restoring spring is used for resetting the piston to the other position.

It will be expedient to provide both push drives with pneumatically operating pistons which work alternately.

Control will be simplified by the use of pistons acting in opposite directions and having different pressure areas.

In accordance with a structurally simple embodiment, the supporting ring itself defines the piston which is pneumatically acted upon in one or in both directions of movement and which is guided in the holding member. Separate pistons can thus be dispensed with.

Alternatively, it is also possible to use, in accordance with a simplified structural design, pistonlike projections on the supporting ring so as to obtain a small number of pieces. The contact areas for the supporting ring provide precise centric positioning at both positions of said supporting ring. The displacement drives only have the function of displacing the supporting ring from one position to the next within the shortest possible time and of positioning said supporting ring at the respective contact area. This permits the use of fast responding and strong displacement drives.

In the case of an embodiment with high operational comfort, the at least one push drive element can be moved out of the removal path of the thread brake element so that this thread brake element can be replaced rapidly and easily in the case of wear and/or in other cases of need. It will be expedient when the removal side of the holding member faces the front end of the storage drum where unhindered accees is possible.

If the restoring spring is accommodated in the push drive element, it will be particularly expedient to arrange a supporting surface in the holding member, the biased restoring spring resting on said supporting surface when the push drive element has been pivoted to the removal position. When a new thread brake element has been inserted and the drive element has been pivoted to its former position, the restoring spring will automatically return to its active position on the supporting ring. The restoring spring resting on said supporting surface holds the displaced push drive element in position.

For achieving a tilt-free and rapid displacement of the supporting ring and of the deformable central portion of the thread brake element, several pairs of push drives are circumferentially distributed on the holding member. The push drives can be connected to a common pressurized air supply means. It is, however, also imaginable to provide a separate supply of pressurized air with a separate control valve for each push drive so that a comparatively large amount of pressurized air can rapidly be supplied to and discharged from each push drive.

In accordance with a particularly expedient embodiment, the controlled output brake is equipped with an annular diaphragm arranged in the supporting ring and provided with an uninterrupted counterbrake lining. The diaphragm defines a built-in, radially and axially resilient spring in the thread brake element, and this results in a desirable self-compensating effect of the output brake, i.e., when the thread speed increases, the thread tension will increase only slightly or not at all, and, consequently, a comparatively high basic thread tension can be adjusted; in the case of the two types of weaving machines dealt with in the present connection, this will entail the important advantage that the lamellar brakes, which have hitherto often been provided downstream of the thread feed device for increasing the thread tension and which have an undesirably strong influence on sudden stretching, can be dispensed with because the comparatively high basic thread tension will be reduced by the pneumatically actuated push drives in cases where no considerable thread tension is required during the picking operation. Alternatively, the thread brake element can also be a so-called brush, tooth or lamellar ring with individual elastically deformable braking elements or with several elastically deformable braking elements that are arranged in groups and with a discontinuous, circumferentially extending counterbrake surface; in the case of this brush, tooth or lamellar ring, the increase in the thread tension and the increase in the braking effect, respectively, which will occur for physical reasons in response to an increase in the thread speed, will be eliminated or markedly reduced by means of the pneumatically actuated push drives if this is desirable in a specific phase of the picking operation.

In a projectile weaving machine including a thread brake which is controlled in dependence upon the weaving cycle and which is arranged downstream of the thread feed device and the controlled output brake in the storage drum, precise thread control can be achieved when both brakes operate approximately in synchronism. When the output brake is engaged in advance, this will have the effect that rapid response and a stabilization of the thread between the storage drum and the controlled thread brake is achieved, without any noticeable influence on the flight of the projectile. The predetermined arrival time of the projectile can be observed precisely in this way, without any necessity of increasing the flying speed in a manner which would be detrimental to the thread.

In a gripper weaving machine equipped with a presenter gripper and receiver gripper, the hitherto necessary lamellar brakes downstream of the thread feed device can be dispensed with. Nevertheless control can be effected in such a way that optimum thread tension characteristics will be obtained throughout the picking operation so as to avoid malfunction when the presenter gripper starts to move, in the transfer phase and at the end of the picking operation.

In projectile weaving machines and gripper weaving machines including the controlled output brake, the sudden stretching, which occurs when the picking operation is started, can be avoided to a large extent or even completely; this is extremely important with regard to sensitive thread qualities, e.g. woolen threads or cotton threads, of inexpensive, poor quality, because these threads can then be processed at the high thread speeds which can be realized in modern weaving machines of these types without the unavoidable high thread breakage rate which has, of necessity, had to be tolerated up to now. An additional advantage is a desirable cleaning effect produced by the pressurized air used for drive control in the thread feed device because the relieved or discharged pressurized air removes fluff and contaminations or prevents them from getting into the interior of the thread feed device from the very beginning.

BRIEF DESCRIPTION OF THE DRAWINGS

Embodiments of the subject matter of the present invention are explained on the basis of the drawings, in which.

DETAILED DESCRIPTION

Figure 1:
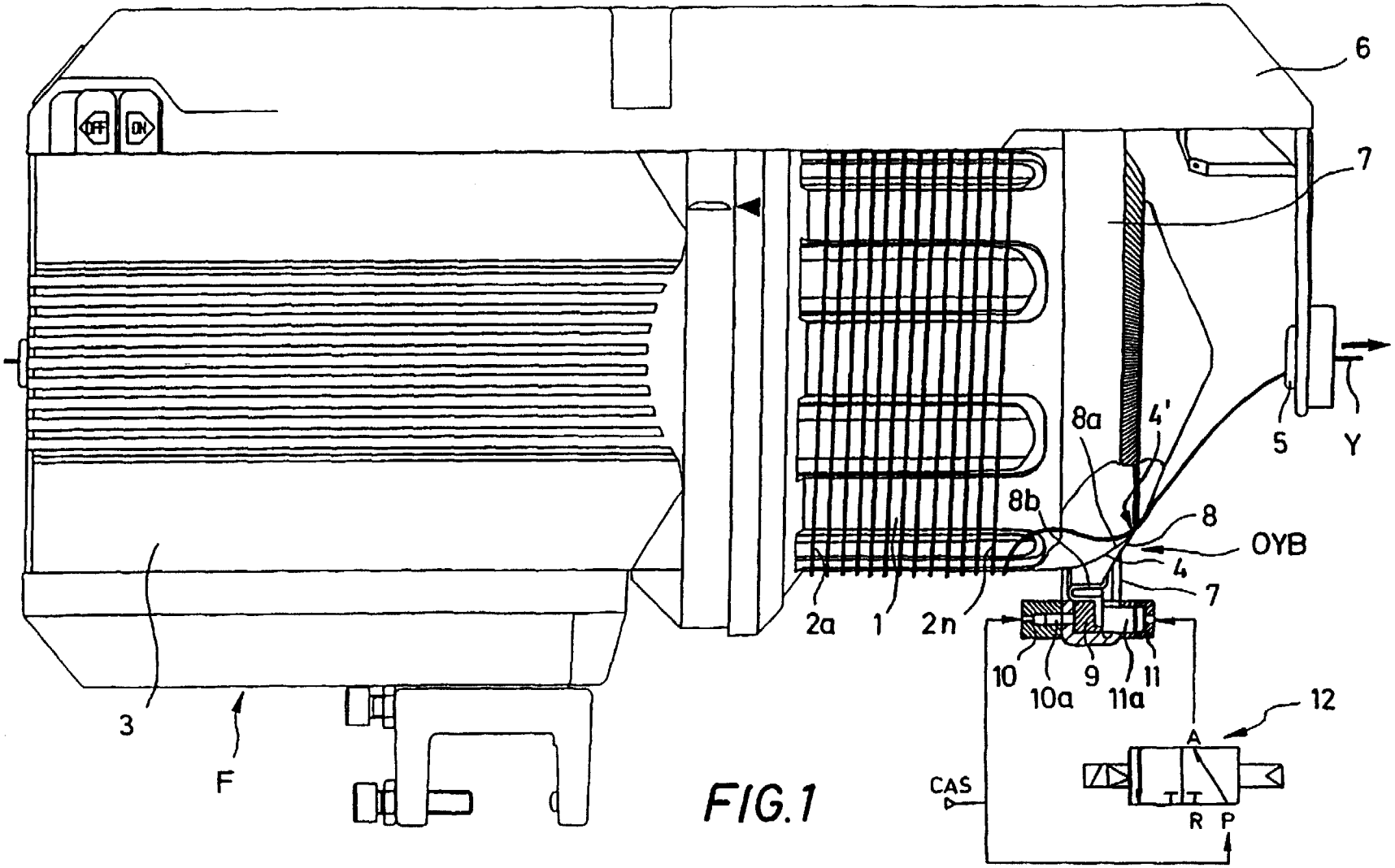
FIG. 1 shows a side view of a thread feed device for a projectile or a gripper weaving machine, at an operating position, part of said side view being a sectional view.
Figure 2:
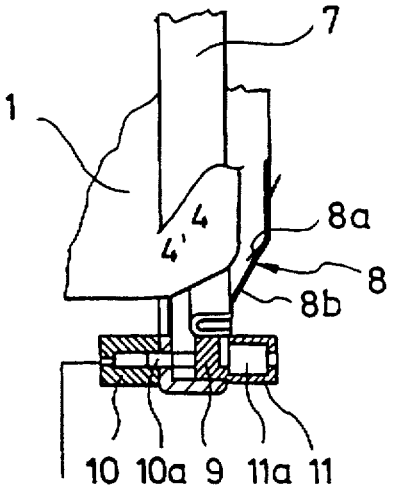
FIG. 2 shows a section of a detail of FIG. 1, at another operating position.

According to FIGS. 1 and 2, a thread feed device F of a type known per se includes a stationary storage drum 1 onto which a plurality of thread windings 2*a* –2*n* can be wound for forming an intermediate thread supply or a thread reserve. The thread Y, which comes from a supply bobbin (not shown), is supplied to the thread feed device through a hollow drive shaft which is adapted to be driven by means of an electric motor (not shown) in a motor frame 3, and is then applied to the storage drum 1 by means of a hollow arm (not shown) which is adapted to be rotatably driven by said drive shaft.

The thread feed device F is arranged between the supply bobbin (not shown) from which the thread Y is unwound by the thread feed device and a textile machine (not shown). The textile machine consumes the thread Y as weft thread for weaving, for knitting, or for producing a textile material in some other way. If the thread feed device F is used for feeding a weft thread to a weaving machine, for drawing off with the aid of insertion means of said weaving machine an amount of thread that corresponds to a plurality of thread windings 2*a*–2*n* during each insertion cycle (pick) into the weaving machine, the thread Y is drawn off the thread reserve. The thread Y is axially drawn off the storage drum 1 by the insertion means of the weaving machine over a storage drum draw-off edge 4, which is preferably slightly rounded, and runs then downstream through an axially arranged draw-off eyelet 5 which extends coaxially with the storage drum 1. Depending on the type of weaving machine, the thread Y can be guided through a freestanding, controlled or alternatively non-controlled thread brake (not shown) and/or through a thread take-up device. These two groups of components are known per se. This is e.g. the case if the thread feed device F is used for feeding the thread Y to a projectile weaving machine in which the weft thread is transported by means of a projectilelike gripper through the shed during each pick.

In an extension arm 6 extending from the motor frame 3, a carriage (not shown) is arranged in the thread feed device F, said carriage being axially displaceable and carrying an annular holding member 7 for a output brake OYB.

The annular holding member 7 carries in FIGS. 1 and 2 a thread brake element 8, which was introduced to the market under the name of "Flexbrake" a short time ago and which substantially comprises a frusto-conical circular ring or a frusto-conical tape of elastic material, preferably rubber. On the basis of its structural design and its arrangement, the circular ring of the thread brake element 8 defines a circumferentially uninterrupted or continuous contact line or contact surface abutting on the rounded draw-off edge 4 of the storage drum 1. The draw-off edge 4 additionally forms a rotationally symmetric brake surface 4' for the contact line of the circular ring 8, said contact line defining a counterbrake surface or a counterbrake line.

The circular ring of the thread brake element 8 is provided with a thin coating on its inside "braking-active" inner area 8*a*, said thin coating consisting of a material which is resistant to the friction caused by the thread, e.g. a metal or a metal alloy, which could be stainless steel or a beryllium copper alloy in an expedient manner. The braking-active inner or internal area or the coating of the thread brake element 8 are characterized by a substantial axial stiffness and a remarkable flexibility or elasticity in the radial direction and by a preferably low inertia (mass). In its area facing the annular support member 7 and/or in its central portion 8*b*, the circular ring of the thread brake element 8 is provided with one or with a plurality of circumferentially extending "corrugations" so as to increase the elasticity of said central portion 8*b*. The central portion 8*b* of the thread brake element 8 is provided on the inner side of a supporting ring 9, which is, in turn, encompassed by the annular holding member 7.

By selecting the axial position of the carriage (not shown) in the extension arm 6, an operator can predetermine the force with which the thread brake element 8 abuts on the draw-off edge 4 (and the brake surface 4', respectively) of the storage drum 1. In this way, the operator can adjust a "basic tension" which will be imparted to the thread Y, when it passes between the braking-active inner area 8*a* of the thread brake element 8 and the rounded draw-off edge 4 while being drawn off the storage drum 1.

The new type of output brake proved to have very advantageous and positive properties in particular for providing advantageous thread tension conditions during each picking operation into a weaving machine. This output brake has a self-compensating effect insofar as the tension in the thread downstream of the output brake does not increase to an extent which would be worth mentioning when the speed of the thread increases.

In spite of these positive conditions that can be achieved by the output brake of the above-mentioned type, which is known per se, it turned out that there is a need to control the thread tension at the outlet of the thread feed device F from "outside"; in so doing, it will be expedient to control the thread tension such that it changes between a predetermined, given level of thread tension and practically a zero tension level or a tension value on a low level.

It is one of the objects of the present invention to suggest a solution for these problems by means of which the wish to obtain an uncomplicated structural design requiring the smallest possible number of components can be fulfilled.

In accordance with the present invention, the thread brake element 8 is arranged in FIGS. 1 and 2 in such a way that it can axially be displaced in a controlled manner so that its braking-active inner area is adapted to assume a number of positions in relation to the rounded draw-off edge 4; an expedient number of positions would be two. Preferably, but not exclusively, the thread brake element is arranged such that it assumes a first axial position (corresponding to FIG. 1) at which its braking-active inner area abuts with a specific, predetermined force on the draw-off edge 4 (and the brake surface 4', respectively) in a "normal" manner. This force is predetermined by the axial position of the carriage (not shown). A specific, predetermined tension in the thread results from this force. Furthermore, the thread brake element is arranged such that it is able to assume a second axial position (according to FIG. 2) at which the braking-active inner area 8*a* of the thread brake element 8 is "detached" from the draw-off edge 4, i.e. it is no longer in contact with said draw-off edge 4. This means, in principle, that the thread can pass "freely" through the gap between the thread brake element and the draw-off edge 4. This has the effect that the thread tension decreases to a low level or to a level which is at least substantially lower than the level occurring when the thread brake element 8 occupies its first axial position.

The controlled axial displacement of the thread brake element 8 can be realized in several ways. In the case of one embodiment, the supporting ring 9 is arranged such that it is axially movable within the holding member 7, e.g. by selecting its extension in the axial direction. A first pneumatic cylinder 10 including a piston 10*a* is provided for cooperating with the rear end face or the rear edge of the supporting ring 9. A second pneumatic cylinder 11 including a piston 11*a* is provided for cooperating with the front end face or the front edge of the supporting ring 9 and a base member 8*c* of the thread brake element 8. The first cylinder 10 is directly connected to a source of pressurized air CAS, whereas the second cylinder 11 is adapted to be connected to the same pressure source via a three-way solenoid valve 12 having a known structural design. (A different type of solenoid valve can be used in the present connection as well, if necessary with modifications of the associated pressurized air circuit). A control unit (not shown) is electrically connected to the valve 12 and should expediently be constructed such that it controls the valve 12 in synchronism with the textile machine, which has thread supplied thereto by the thread feed device F; this means that in the case of a weaving machine, control is effected in synchronism with the weaving cycle, preferably in correspondence with a desired expedient thread tension during respective phases of the weft thread insertion cycle, such as the acceleration phase, the "flight" phase, the deceleration phase, etc..

The description of the function of the embodiment shown starts with the operating position according to FIG. 1. At this operating position, the control unit keeps the solenoid valve 12 in its non-active state, and this has the effect that the piston 11*a* in the second cylinder 11 remains at its left end position. In view of the fact that the first cylinder 10 is directly connected to the source of pressurized air CAS, the piston 10*a* always tries to move towards it right end position. At this starting position, the force which the piston 11*a* applies to the supporting ring 9 and, consequently, also to the thread brake element 8 as a whole is, however, stronger than the force applied by the piston 10*a* in view of the fact that the piston 11*a* has a cross-sectional area and, consequently, a pressure area which is larger than the cross-sectional area of said piston 10*a*. This means that the thread brake element 8 has its supporting ring 9 located at the left "rear" working position or that said supporting ring 9 assumes said position, i.e the braking-active position. As soon as the control unit actuates the solenoid valve 12, the piston 11*a* will assume its right end position, since the cylinder 11 is no longer acted upon by pressure, whereas the cylinder 10 is still acted upon by pressure. This has the consequence that the supporting ring 9 and, consequently, the thread brake element 8 are displaced to the right to the "front" position, i.e. the braking-inactive position, at which the thread brake element 8 is detached from the draw-off edge 4.

The stroke of the axial displacement motion of the thread brake element 8 and its supporting ring 9 need, in an expedient manner, not be larger than a few millimeters for achieving the desired function as a result. The time for "switching" the thread brake element "over" or for displacing it between its working positions can be 10–15 milliseconds in the case of the embodiment described.

The axial displacement of the thread brake element 8 may be caused in different ways, e.g. by means of electromagnets or solenoids, which act directly on the supporting ring 9, or, alternatively, with the aid of displacement means which are controlled by piezoelectric crystal elements (in view of the fact that the necessary change-over movement is so short), or with the aid of other known types of linear adjustment means.

For simplifying the description, only one pneumatic displacement unit (cylinders 10 and 11) is shown in the case of the embodiment shown in the present connection. It must be emphasized that the number of such units should at least be three, and that these units are uniformly distributed around the circumference of the thread brake element so as to guarantee sufficient homogeneity and speed when the thread brake element is being displaced.

It is also possible, although this will entail the disadvantage of a slightly more complicated device, to enlarge the number of "working positions" of the thread brake element so as to achieve more than two different thread tension levels. In the case shown, the function in question is, in principle, only an "ON and OFF function".

Figure 4:
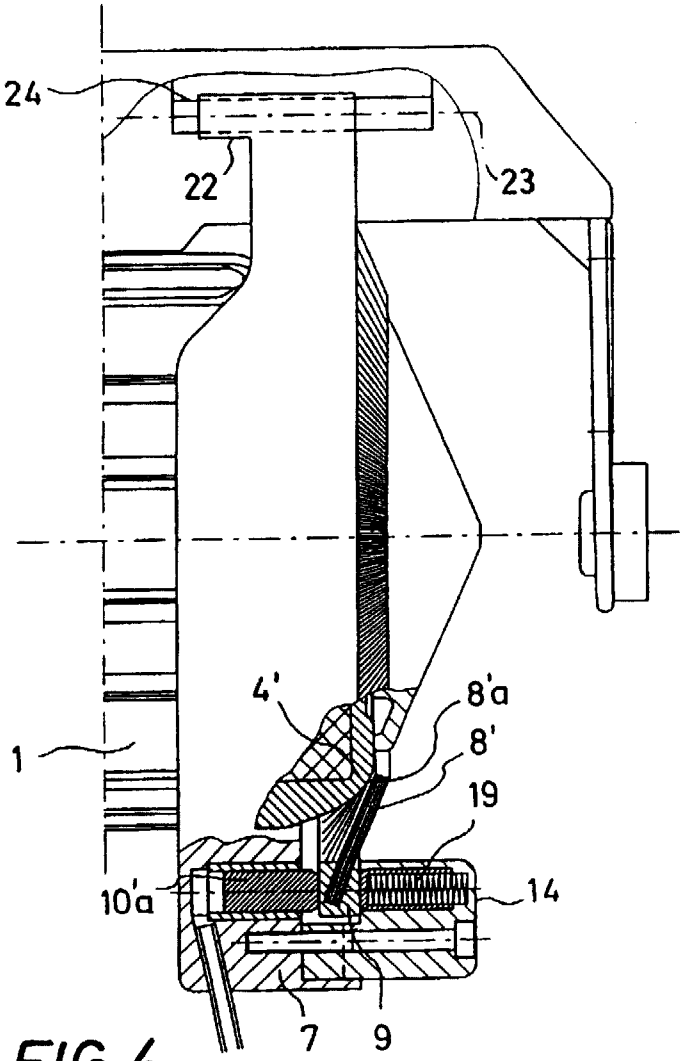
FIGS. 3 and 4 show another embodiment at two different operating positions, part of said FIG. 3 and 4 being sectional views.
Figure 3:
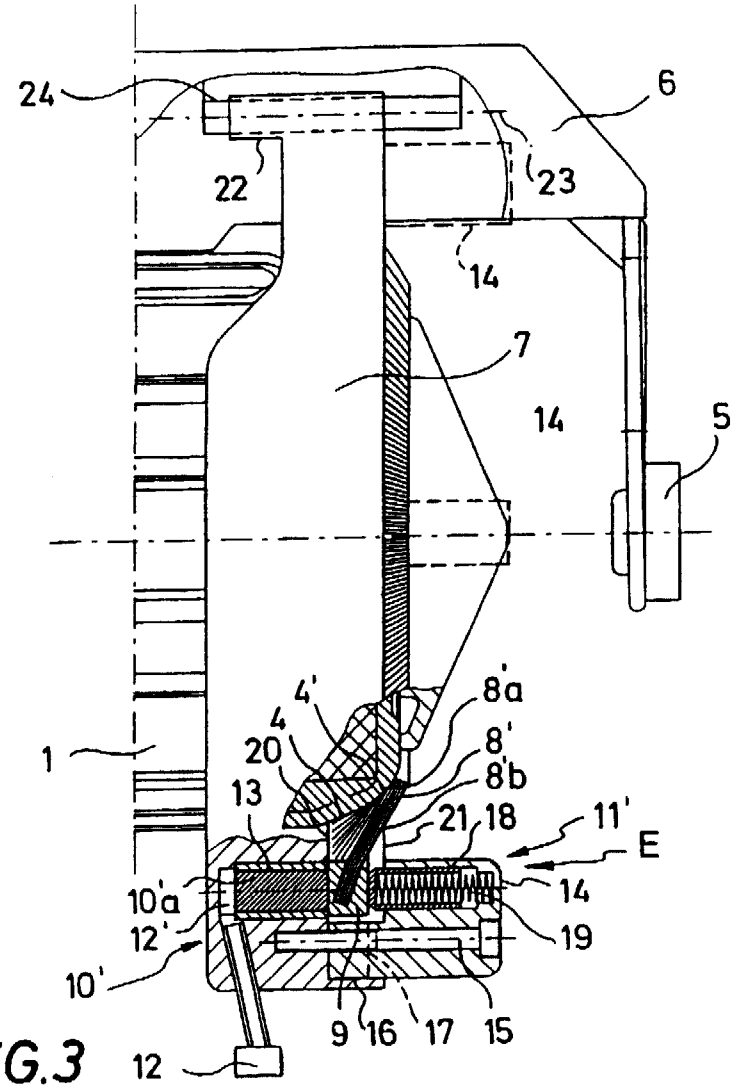
Figure 5:
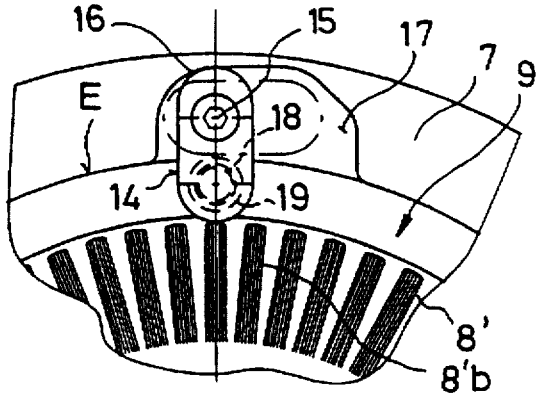
FIG. 5 shows part of a front view of the embodiment of FIGS. 3 and 4.

In the embodiment according to FIGS. 3, 4 and 5, a different embodiment of a pneumatically actuated output brake OYB is provided in the holding member 7 on the extension arm 6 of the thread feed device. The basic axial adjustment of the holding member 7 and, consequently, the basic adjustment of the thread tension in the engaged condition of the output brake is chosen with the aid of a carriage 22 travelling in guide means 24, said carriage 22 being connected to said holding member 7. The carriage can be moved by means of an adjustment member 23; during operation, it is, however, stationary. The holding member 7 is open towards the removal side E (towards the front end of the storage drum 1) and includes circumferentially distributed reception means 16 for push drive elements 14, which are adapted to be moved to and fro, either individually or in combination, between a hold position (shown by solid lines in the drawing) and a removal position (indicated by broken lines in FIG. 5), said movement preferably taking place about an axially parallel holding screw 15. At the hold position, each push drive element 14 engages behind the supporting ring 9 of the thread brake element 8', which is a so-called bristle ring with flexible bristles or bunches of bristles in FIGS. 3–5, said bristles or bunches of bristles extending preferably from the supporting ring 9 at an oblique angle inwards and defining an elastically deformable central portion 8*b*' and an internal braking-active inner area 8*a*' cooperating as a counterbrake surface with the brake surface 4' at the draw-off edge 4. The holding member 7 has arranged therein two push drives 10', 11' which act in opposite directions. The push drive 10' contains in a slide guide means or chamber 12' the piston 10*a*', which, for the purpose of improved sealing and neat guidance, is guided in a sliding sleeve 13 and is adapted to have applied thereto and taken away therefrom pressurized air from the pneumatic drive control unit 12 (cf. FIG. 1). In the holding member 7, a radial surface defines a first ring contact area 20, a contact area 21 on the push drive elements 14 being located opposite said first ring contact area 20 when seen in the axial direction. The distance between the contact areas 20 and 21 exceeds the axial width of the ring 9 of the thread brake element 8' e.g. by 2 to 4 mm. The piston 10*a*' is adapted to be moved beyond the first contact area 20. Each push drive element 14 contains an axially arranged restoring spring 19, which is accommodated in a recess and which acts on the supporting ring 9 preferably via a sleeve 18. The restoring spring 19 is biased and adapted to be moved beyond the second contact area 21. The reception means 16 for the push drive element 14 is dimensioned such that, after having been rotated about the holding screw 15, said push drive element 14 is removed from the removal path of the supporting ring 9. When all push drive elements 14 have rotatably been displaced, the thread brake element 8' can be removed towards the removal side E and replaced by a new or a different type of thread brake element (e.g. the thread brake element 8 according to FIG. 1). Other thread brake elements which are adapted to be used for this purpose are so-called toothed rings having elastic teeth projecting inwards in the supporting ring 9 and consisting of plastic material or of some other material (similar to an annular comb), or a lamellar brake ring carrying sheet-metal lamellae or plastic lamellae which project inwards in the supporting ring 9. Provided that the above-mentioned thread brake elements have approximately identical external diameters of the supporting rings 9, they can selectively be exchanged for one another.

In the reception means 16, a supporting surface 17 for the restoring spring 19 is provided, said supporting surface 17 being provided such that the restoring spring 19 is positioned approximately on one level with the rear end face of the supporting ring 9, when said supporting ring 9 is pressed against the first contact area 20. This has the effect that, during the rotary displacement of each push drive element 14 for the purpose of removing the respective thread brake element, the biased restoring spring 19 and the sleeve 18, respectively, will slide onto the supporting suface 17, the restoring spring 19 having, however, no chance to relax. Due to the force of the restoring spring 19 on the supporting surface 17, the push drive element 14 is automatically secured in position at the removal position. When a new or a different type of thread brake element has correctly been inserted, the still biased and retracted restoring spring 19 will again be moved onto the supporting ring 9 during the rotational return movement of the push drive element 14. As soon as the restoring spring 19 has been released from the supporting surface 17, the push drive 11' is ready to function again.

In FIG. 3, the piston 10*a*' is not pneumatically acted upon. The restoring spring 19 maintains the supporting ring at a position where it abuts on the first contact area 20. The output brake OYB works with the contact pressure adjusted by the position of the carriage 22.

If each piston 10*a*' has pressure applied thereto from the pneumatic drive control unit 12, the supporting ring 9 is abruptly displaced in the axial direction onto the second contact area 21 against the force of the restoring spring 19, the braking-active inner area 8*a*' contacting, in an expedient manner, the brake surface 4' only weakly or no longer at all. This operating position is outlined in FIG. 4. It will be expedient to secure every push drive element 14 at the hold position by tightening the holding screw 15. It would, however, also be imaginable to provide an automatically acting detent means. Furthermore, it is also possible to adjust the displacement path of the supporting ring 9 between the first and second contact areas 20 and 21, e.g. by inserting or removing washers between the push drive element 14 and the holding member 7. It is also possible to provide two respective pistons which are acted upon pneumatically, like in FIGS. 1 and 2.

Figure 6:
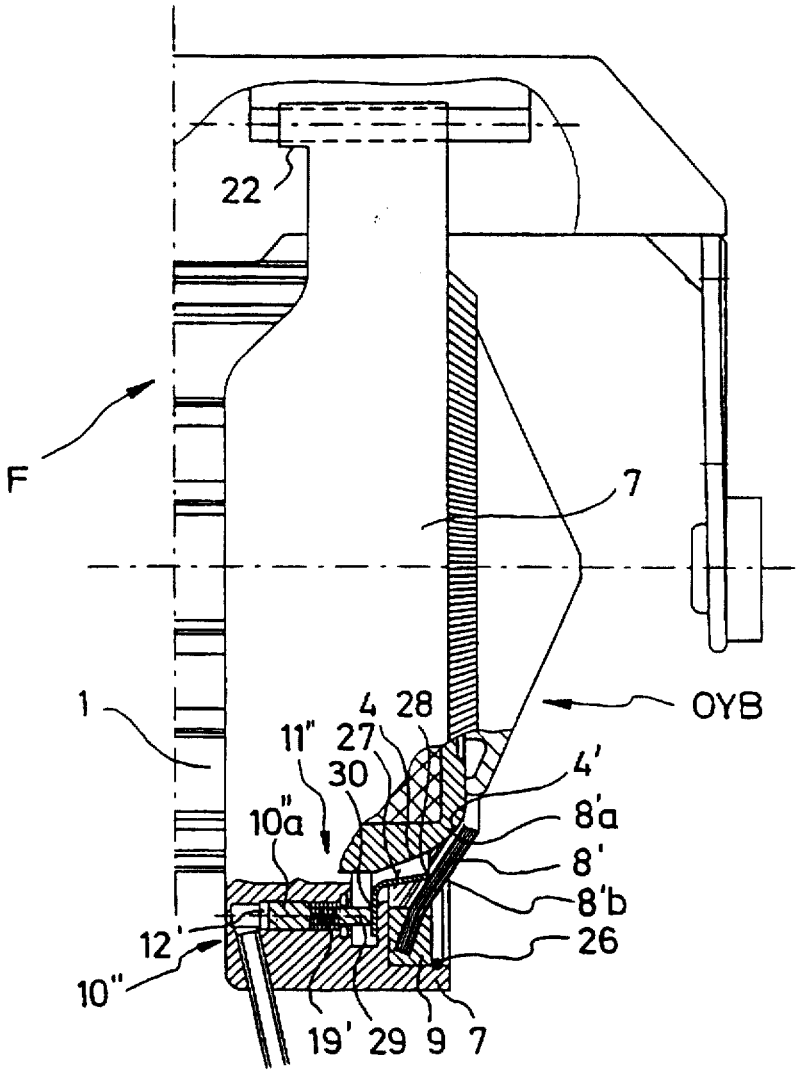
FIG. 6 shows a view of an additional embodiment at an operating position, part of said view being a sectional view.

In the case of the embodiment of the controllable output brake OYB on the storage drum 1 of the thread feed device F according to FIG. 6, the push drives 10" and 11" serve to axially displace a ring element 27 which is concentric with the axis of the storage drum 1 and which directly acts via a pushing end 28 onto the elastically deformable central portion 8*b*' of the thread brake element 8' (here a bristle ring) radially within the supporting ring 9. The supporting ring 9 is secured in position in a stationary manner in the holding member 7, e.g. by means of a retainer ring 26 that can be dismounted easily. The two push drives 10" and 11" are combined with one another, i.e. the piston 10*a*" in the slide guide means 12' acts on the ring element 27 by means of a piston rod 29, which can be coupled to said ring element 27 at 30, whereas the restoring spring 19' is arranged on the piston rod 29 and works against a stop provided on the end of the slide guide means 12'. By means of the piston 10*a*", the ring element 27 is displaced in FIG. 6 to the right until it abuts on a stop in the holding member 7, as soon as the piston 10*a*" has applied thereto pressurized air from the pneumatic drive control unit, which is not shown. As soon as the pressure applied is reduced, the restoring spring 19' will return the piston 10*a*"; also the ring element 27 is drawn back via the piston rod 29, said ring element being drawn back in an expedient manner against a second stop of the holding member 7. At the position shown in FIG. 6, the controllable output brake OYB is disengaged, i.e. the braking-active inner area 8' contacts the brake surface 4' of the draw-off edge 4 essentially only weakly or no longer at all. The central portion 8*b*' is axially deformed relative to the supporting ring 9.

As soon as the application of pressurized air is reduced, the restoring spring 19' will cause a return movement of the ring element 27 until the braking-active inner area 8*a*' abuts on the braking surface 4' with the force preselected by the position of the carriage 22. The restoring spring 19' could also be arranged on the right-hand side of the ring element 27 so that the piston 10a" acts directly on said ring element 27. Furthermore, it would be possible to use, as has been done in FIG. 1, pistons that are pneumatically acted upon for both directions of movement. In addition, the positions of installation of the piston 11a" and of the restoring spring 19' could also be reversed. Instead of the thread brake element 8' provided with bristles, a Flexbrake brake element 8 according to FIGS. 1 and 2 or a toothed ring or a lamellr ring could be used.

Figure 7:
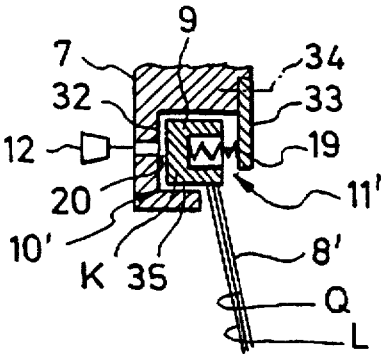
FIGS. 7 and 8 show sectional views of two additional variations.

In the case of the schematically shown embodiment according to FIG. 7, the supporting ring 9 in the holding member 7 simultaneously forms a piston K of the pneumatic push drive 10'. The restoring spring 19 is either accommodated in a push drive element 14 of the push drive 11' for the other direction of movement, as has been done in FIGS. 3 to 6, or 13 as shown—in a recess of the supporting ring 9 so that a projection 33 can be used, said projection 33 being adapted to be pivoted to the side about an axis 34 in the holding member 7. The supporting ring 9 has applied thereto pressurized air directly from the pneumatic drive control unit 12, if necessary through several distributed inlets. The first contact area is located in the interior of an annular chamber 32 of the holding member 7. The annular chamber 32 defines inner and outer sealing areas 35 with the supporting ring 9. If necessary, a sort of packing ring is provided, which could also be provided in the case of the pistons 10a, 11a, and 10a" and 10a', respectively, for preventing excessive leakage of pressurized air and for guaranteeing a constantly low displacement resistance of the respective piston. FIG. 7 again shows a bristle brake ring as thread brake element 8'. The individual bristles are designated by the reference symbol Q, the inner sides of said bristles defining the braking-active inner area and, consequently, a counterbrake surface L. A Flexbrake thread brake element 8 or a toothed ring or a lamellar ring could, however, be used for the same purpose as well.

Figure 8:
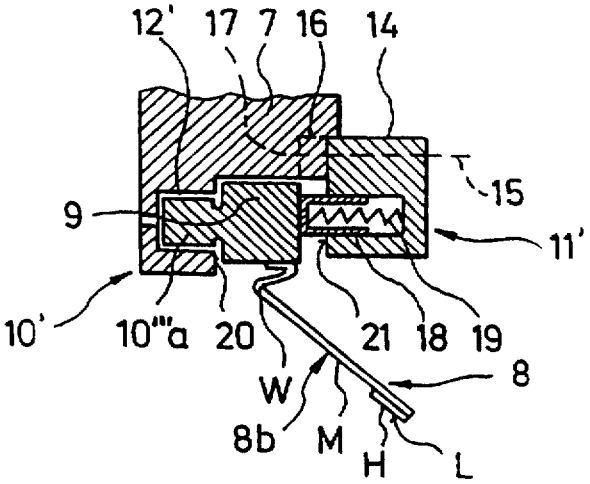

In the embodiment according to FIG. 8, a plurality of circumferentially distributed, cylindrical projections are provided on the supporting ring 9 as pistons 10a"', which are inserted into slide guide means 12' of the holding member 7 where they are acted upon by pressurized air, said cylindrical projections being preferably formed integrally with said supporting ring 9. They form the push drives 10' which are responsible for one direction of movement and which are distributed over the circumference of the holding member 7 at regular intervals. The push drives 11' responsible for the other direction of movement have a structural design corresponding e.g. to that shown in FIGS. 3 to 5 and they are provided with restoring springs 19 so that a detailed explanation can be dispensed with. The thread brake element 8 is a Flexbrake thread brake element according to FIGS. 1 and 2 comprising a diaphragm M consisting of rubber or of an elastic elastomer and having the shape of a circular ring or of a truncated cone, said diaphragm M including at least one circumferentially extending corrugation W, which increases its elasticity and its resilient properties in the radial as well as in the axial direction. In the inner area of the central diaphragm portion 8b, which is located within said corrugation W, a circumferentially extending, frusto-conical brake lining H is attached, e.g. by means of an adhesive, to the inner side, said brake lining defining the counterbrake surface L for the brake surface 4' of the draw-off edge 4. The brake lining H consists of a material that is resistant to the friction caused by the thread, e.g. stainless steel or a copper beryllium alloy and is comparatively stiff in the axial direction, whereas it is remarkably elastic in the radial direction. Also in the case of this embodiment, another thread brake element may be used instead of the thread brake element 8.

Figure 9:
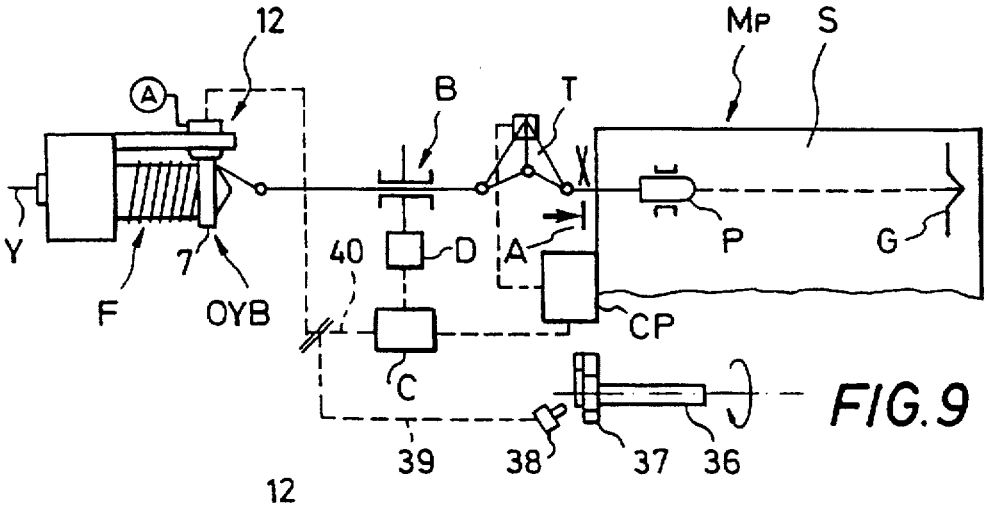
FIG. 9 shows a schematic view of a weft thread processing system of a projectile weaving machine.

In FIG. 9, a projectile weaving machine MP is schematically outlined with only one thread feed device F. The thread feed device F is arranged in alignment with the shed S and secured in position in a stationary manner in spaced relationship with said shed S. The thread Y comes from a supply bobbin (not shown), a sufficient amount of said thread Y being stored temporarily on the storage drum of the thread feed device and said thread being drawn off by the controlled output brake OYB in the holding member 7. A stationary thread eyelet can be provided in the thread path leading from the thread feed device into the shed S, a controlled thread brake B being located behind said eyelet. Between the controlled thread brake B and a drive means A for a projectil P, which is to be shot transversely through the weaving shed S, a take-up device T is provided, which is controlled in dependence upon the weaving cycle and which has at least one arm taking hold of the thread Y and adapted to be moved up and down relative to fixed thread guiding points. On the other end of the shed S, a catch device G for the projectile is provided in opposed relationship with the drive means A, when seen in the direction of insertion. The controlled thread brake B is controlled in dependence upon the weaving cycle by a control unit CP of the projectile weaving machine MP and has, if desired, a separate control unit C controlling a drive D. The control unit CP and/or the control unit C is/are connected to the pneumatic drive control unit 12 of the output brake OYB via a line 40 in such a way that the output brake OYB will be opened or closed approximately in synchronism with the controlled thread brake. Alternatively, the pneumatic drive control unit 12 (the solenoid valve of said drive control unit 12) can be connected to a sensor 38 via a separate control line 39, said sensor 38 being arranged in alignment with an emitter 37, which is adapted to be rotated together with the main shaft 36 of the projectile weaving machine MP, so as to tap off, in dependence upon the rotational angle of said main shaft 36, the control commands for disengaging or engaging the output brake OYB and also the periods of time over which said output brake OYB is to be disengaged or engaged.

When the projectile weaving machine MP is in operation, the thread Y held ready near the drive means A is first transferred to a projectile P and then shot through the shed S by means of said projectile P before the projectile P and the thread Y connected thereto are seized by the catch device G. Immediately before the picking operation is started, the controlled thread brake B is disengaged and the controlled output brake OYB on the thread feed device F is disengaged as well. Towards the end of the flight of the projectile, the controlled thread brake B is engaged and the controlled output brake OYB is engaged as well, approximately in synchronism with said thread brake B. It will be expedient to engage the controlled output brake OYB slightly in advance so as to prevent the thread Y from losing tension or sagging between the controlled thread brake and the thread feed device F and so as to suppress ballooning. In this connection, it is important that the controlled output brake OYB is rapidly engaged so that it will produce the right effect with regard to thread control on the one hand and so that a delay of the projectile flight will be excluded on the other.

Figure 11:
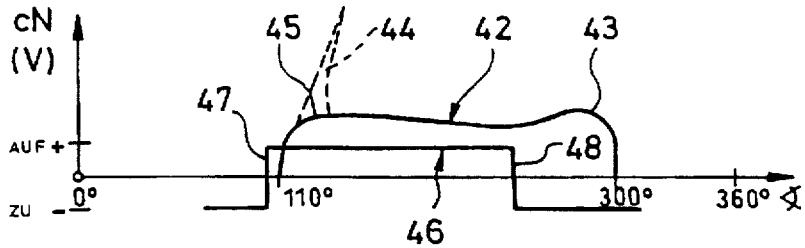
FIG. 11 shows an operating diagram for the system of FIG. 9.

FIG. 11 clearly shows the sequence of steps during one picking operation. The horizontal axis of the diagram is representative of the angle of rotation for one rotation of the main shaft 36 of the projectile weaving machine MP, whereas the vertical axis represents the thread tension (cN) and the switching voltage (V) for the solenoid valve. Curve 42 is representative of the thread tension behavior, whereas curve 46 is representative of disengagement and engagement and of the sections of the rotational angle throughout which the output brake is engaged and disengaged, respectively. Weft insertion starts at a rotational angle of e.g. 110°. As soon as the projectile P is accelerated, the tension of the thread will increase until a predetermined value has been reached and then it will be approximately uniform until, due to the controlled thread brake B, the thread tension level will first increase in a curve area 43 and then decrease when the projectile P stands still and is then returned. Due to the extreme acceleration of the projectile at the beginning of the picking operation and due to an uncontrolled brake means, the dreaded sudden stretching would occur in projectile weaving machines MP in the vicinity of or downstream of the thread feed device F, said sudden stretching being represented by the tension peak 44 indicated by broken lines. However, in view of the fact that the controlled output brake OYB is disengaged a few angular degrees before the picking operation is started (indicated at 47) and in view of the fact that the thread feed device can be placed extremely close to the controlled thread brake (whereby space can be saved), sudden stretching 44 can be minimized to a large extent or completely avoided so that a harmonic curve characteristic will be obtained in the area 45. The controlled output brake OYB remains disengaged until the picking operation has almost been finished and is engaged (indicated at 48) only a short time before the controlled thread brake B is engaged. The output brake OYB will then remain engaged until the picking operation has been finished so as to control the thread between the thread feed device and the controlled thread brake in a precisely predetermined manner. Irrespectively of whether the output brake OYB is engaged or disengaged, it will permanenetly fulfil a balloon-limiting or balloon-breaking function.

Figure 10:
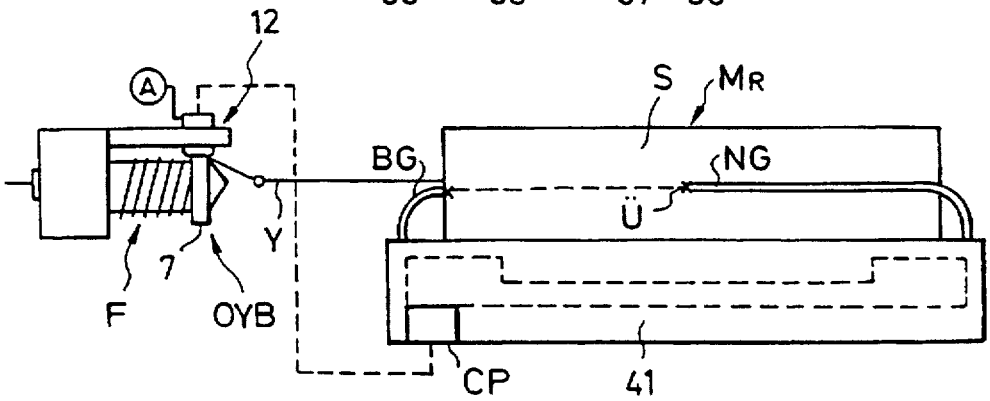
FIG. 10 shows a schematic view of a weft thread processing system of a gripper weaving machine.

FIG. 10 is a schematic representation of a gripper weaving machine MR with only one thread feed device F. A presenter gripper BG and a receiver gripper NG are used as an insertion device, the movements of said presenter gripper BG and said receiver gripper NG being controlled through a drive means 41 and a central control unti CP in such a way that said presenter gripper and receiver gripper insert the thread Y from one side of the shed S to the other side of said shed. The presenter gripper BG transfers the thread in a transfer region U to the receiver gripper NG which finishes the transport of said thread though the shed S. It will be expedient to connect the control unit CP to the pneumatic drive control unit 12 of the controllable output brake OYB in the holding member 7 of the thread feed device for repeatedly disengaging and re-engaging the controlled output brake OYB during each picking operation.

Figure 12:
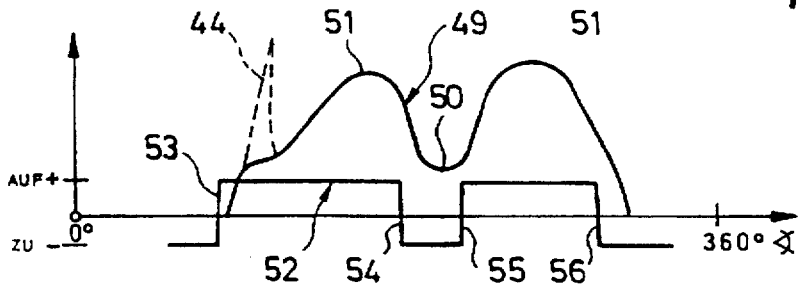
FIG. 12 shows an operating diagram for the system of FIG. 10.

In the diagram according to FIG. 12, the horizontal axis again represents the rotational movement of the main shaft of the gripper weaving machine MR from 0° to 360°. The vertical axis represents the thread tension (cN) and the switching voltage (V) for the solenoid valve of the pneumatic drive control unit. An approximately heart-shaped curve 49 is obtained for the behaviour of the thread tension during one weft insertion operation. In the peak areas 51, the thread tension increases due to the acceleration of the presenter gripper and the receiver gripper. In the transfer region, the curve portion 50 having a low thread tension level is obtained. Normally, the thread feed device has provided thereon an uncontrolled thread brake and, if necessary, even at least one additional lamellar brake with fixed adjustment that is provided downstream of the thread feed device. This arrangement would result in the sudden stretching represented by the increase in tension 44 which is shown by the broken line. Since, however, the controlled output brake OYB is disengaged a short time before the picking operation (represented by 53) is started, the lamellar brake can be dispensed with, and the thread feed device can be arranged very close to the shed (saving of space), sudden stretching 44 can essentially be minimized or eliminated completely. The output brake OYB should be disengaged only immediately before the picking operation is started so as to avoid any uncontrolled or untensioned condition of the thread Y prior to said picking operation. For guaranteeing perfect transfer of the thread Y in the transfer region Ü between the presenter gripper and the receiver gripper, it will be necessary to build up a certain tension. For this purpose, the controlled output brake OYB is engaged during the transfer phase (represented at 54 of curve 52 of the switching signal for the pneumatic drive control unit), and then rapidly disengaged after the transfer phase (represented by 55), prior to being re-engaged before the end of the picking operation (represented by 56). This results in precisely controlled thread guidance and a thread tension profile in the case of which even delicate thread material is treated gently and which permits the high thread speeds that are possible in modern gripper weaving machines to be utilized without any risk of thread breakage. The gripper weaving machine MR can in this case be operated without any permanently effective brakes which are arranged downstream of the thread feed device F and which would have a negative influence on the tension characteristic (sudden stretching and high peak areas 51).

In general practice, the solenoid valve of the pneumatic drive control unit 12 is accommodated at a protected position in the interior of the motor frame 3 and the supply lines are installed invisibly. The solenoid valve causes the pressurized air, which has been supplied for acting on the pistons, to flow off directly when switching over is effected; it will be expedient when said pressurized air flows off in the interior of the motor frame so as to prevent by means of an overpressure effect or a dynamic flow the ingress of contaminations and fluff. It is even possible to conduct the pressurized air purposefully so that critical areas (the electronic components) in the engine frame or the normally provided sensor means can be kept clean or can be cleaned or cooled quite generally. Normally, it will suffice to provide one solenoid valve which supplies and relieves all pneumatically operated push drives together. It is, however, also imaginable to associate a separate solenoid valve with every pneumatically operated displacement drive so that the necessary pressure can be built up rapidly and so that the pressurized amount of air can be discharged rapidly. The pistons, the holding member 7 and possible slide guide means of the displacement drives can consist of metal. It will be expedient when the supporting ring 9 of the thread brake element is a plastic component having a shape of such a nature that it has very little mass combined with dimensional stability. The brake surface 4' is arranged either in the area of the draw-off edge 4 of the storage drum, or it may also be arranged at the so-called front cone or nose portion of the storage drum. In the first case, the brake surface and the counterbrake surface cooperate on a diameter of the storage drum that is slightly smaller than the diameter on which the thread windings *2a–2n* are located. In the second case, the diameter on which the brake surface cooperates with the counterbrake surface is smaller than in the first case. Control in the controllable output brake OYB in dependence upon the picking characteristic is preferred. It is, however, also imaginable to effect the control by means of a microprocessor, which is provided in the control unit of the thread brake element anyhow, and to perform for this purpose a program with an exactly predeterminable time sequence of disengagement and re-engagement during each picking operation.

I claim:

1. A controllable output brake in a thread feed device for projectile or gripper weaving machines, comprising a stationary storage drum which has thread supplied thereto and stored thereon in windings and from which said thread is drawn off discontinuously and overhead into a shed, said storage drum having a rotationally symmetric brake surface, said output brake including an elastically deformable thread brake element, which said thread brake element is adapted to be pressed against said brake surface and is provided with an outer supporting ring, said supporting ring being closed in the circumferential direction and arranged in a holding member encompassing the storage drum in a contact-free manner, a drive control unit and a displacement drive which is arranged in the holding member and is adapted to be controlled by means of said drive control unit when the thread feed device and the weaving machine are in operation, said displacement drive acting on the supporting ring and being used for varying the force with which the thread brake element is pressed against the brake surface, comprising the improvement wherein the supporting ring of the thread brake element is adapted to be moved in said holding member in the axial direction of the storage drum with a predetermined amount of axial play relative to the brake surface in two opposite directions, said displacement drive comprising at least one push drive for each of said directions of movement of the supporting ring which said push drive is connected to the holding member and operates exclusively parallel to the axis of said storage drum, said push drive acting directly on the supporting ring and being adapted to be used for positioning said supporting ring on a holding-member contact area located opposite thereto in the respective direction of movement.

2. A controllable output brake according to claim 1, wherein one said push drive is connected to the drive control unit and has a piston which is arranged in a slide guide means of the holding member such that said one push drive directly acts on the supporting ring, another said push drive being provided with at least one permanently active, biased restoring spring which is contained in a sleeve.

3. A controllable output brake according to claim 2, wherein the holding member is open towards a removal side of the thread brake element and has on said removal side at least one push drive element which is adapted to be moved to and fro between a removal position located outside of a removal path of the thread brake element to permit removal of the thread brake element and a self-holding hold position at which the push drive element engages behind the supporting ring to hold the thread brake element in the holding member, the restoring spring being extendably supported in the push drive element, the holding member being provided with a restoring-spring supporting surface, which is located in a recess for the push drive element so that said push drive element is movable to the removal position by a pivotal movement, said supporting surface being arranged at a distance from the first contact area which corresponds approximately to an axial width of the supporting ring.

4. A controllable output brake according to claim 1, wherein two said push drives are provided which each include a piston, said pistons acting in opposite directions and being adapted to be acted upon alternately by the drive control unit.

5. A controllable output brake according to claim 1, wherein two said push drives are provided which respectively include therein two pistons acting in opposite directions, each of said pistons having a pressure area and said drive control unit being pneumatic so as to act pneumatically on said pressure areas, the pressure area of one of said pistons being larger than the pressure area of the other of said pistons, the other piston being adapted to be pneumatically acted upon permanently, whereas the one piston is pneumatically acted upon only in cycles.

6. A controllable output brake according to claim 1, wherein the supporting ring is constructed as a piston of said at least one push drive, said supporting ring adapted to be directly acted upon by the drive control unit in the holding member, said holding member defining a slide guide means for said supporting ring.

7. A controllable output brake according to claim 1, wherein the supporting ring has arranged thereon piston-like projections which are preferably formed integrally with said supporting ring and engage slide guide means provided in said holding member, said piston-like projections being adapted to be pneumatically acted upon in said slide guide means.

8. A controllable output brake according to claim 1, wherein the contact areas have an approximately annular shape and are provided in parallel in the holding member, said contact areas being arranged in alignment with the supporting ring and at an axial distance from one another that is larger than an axial width of the supporting ring.

9. A controllable output brake according to claim 1, wherein the holding member is open towards a removal side of the thread brake element and has on said removal side at least one push drive element which is adapted to be moved to and fro between a removal position located outside of a removal path of the thread brake element to permit removal of the thread brake element and a self-holding hold position at which the push drive element engages behind the supporting ring to hold the thread brake element in the holding member.

10. A controllable output brake according to claim 1, wherein the supporting ring has supported thereon an annular diaphragm consisting of rubber or of an elastomer and defining a central portion, said diaphragm having formed therein at least one concentric, circumferentially extending resilient corrugation, an inner diameter and carrying in the area of said inner diameter a frusto-conical, circumferentially extending, wear-resistant brake lining defining an uninterrupted counterbrake surface of the thread brake element.

11. A controllable output brake in a thread feed device for projectile or gripper weaving machines, comprising a stationary storage drum which has thread supplied thereto and stored thereon in windings and from which said thread is drawn off discontinuously and overhead into a shed, said storage drum having a rotationally symmetric brake surface, said output brake including an elastically deformable thread brake element, which said thread brake element is adapted to be pressed against said brake surface and is provided with an outer supporting ring, said supporting ring being closed in the circumferential direction and arranged in a holding member encompassing the storage drum in a contact-free manner, a drive control unit and a displacement drive which is arranged in the holding member and is adapted to be controlled by means of said drive control unit when the thread feed device and the weaving machine are in operation, said displacement drive acting on the supporting ring and being used for varying the force with which the thread brake element is pressed against the brake surface, comprising the improvement wherein the supporting ring of the thread brake element is provided with a central portion that is deformable relative to the brake surface axially and elastically in two opposite directions, said supporting ring being supported in the holding member in an axially immovable manner with respect to the holding member, said displacement drive comprising at least one push drive provided on the holding member for each of said axial deformation directions of said central portion, said push drive operating parallel to the axis of the storage drum and acting directly on said deformable central portion, a ring element which is concentric with the axis of the storage drum being supported on said holding member in an axially displaceable manner, said ring element having a pushing end which is in alignment with the central portion and is adapted to be acted upon by said at least one push drive so as to displace said ring element between a release position defined by a first stop of the holding member and a passive position defined by a second stop of the holding member, said central portion being, at said release position, elastically deformed by the pushing end in the axial direction relative to the supporting ring, whereas, at said passive position, the pushing end will at most abut approximately weakly on said central portion.

12. A controllable output brake according to claim 11, wherein the supporting ring has supported thereon an annular diaphragm consisting of rubber or of an elastomer and defining a central portion, said diaphragm having formed therein at least one concentric, circumferentially extending resilient corrugation and carrying in the area of its inner diameter a frusto-conical, circumferentially extending, wear-resistant brake lining defining an uninterrupted counterbrake surface of the thread brake element.

13. A projectile weaving machine comprising at least one thread feed device provided with a controllable output brake, said output brake comprising a stationary storage drum which has thread supplied thereto and stored thereon in windings and from which said thread is drawn off discontinuously and overhead into a shed, said storage drum having a rotationally symmetric brake surface, said output brake including an elastically deformable thread brake element, which said thread brake element is adapted to be pressed against said brake surface and is provided with an outer supporting ring, said supporting ring being closed in the circumferential direction and arranged in a holding member encompassing the storage drum in a contact-free manner, a drive control unit and a displacement drive which is arranged in the holding member and is adapted to be controlled by means of said drive control unit when the thread feed device and the weaving machine are in operation, said displacement drive acting on the supporting ring and being used for varying the force with which the thread brake element is pressed against the brake surface, the supporting ring of the thread brake element being adapted to be moved in said holding member in the axial direction of the storage drum with a predetermined amount of axial play relative to the brake surface in two opposite directions, said displacement drive comprising at least one push drive for each of said directions of movement of the supporting ring which said push drive is connected to the holding member and operates exclusively parallel to the axis of said storage drum, said push drive acting directly on the supporting ring and being adapted to be used for positioning said supporting ring on a holding-member contact area located opposite thereto in the respective direction of movement, said projectile weaving machine further comprising a thread brake controlled in dependence upon the weaving cycle as well as a take-up device between the output brake and the shed, the drive control unit of the output brake being connected to a control of the controlled thread brake or of the weaving machine in such a way that, when the controlled thread brake is being disengaged, the braking effect of the output brake can be reduced approximately synchronously until the thread brake element abuts approximately weakly on the brake surface, and, when the controlled thread brake is being engaged, said braking effect can be increased approximately synchronously, preferably slightly in advance, until a maximum value has been reached, which is predetermined by the basic axial adjustment of a holding-member carriage.

14. A gripper weaving machine comprising at least one thread feed device provided with a controllable output brake, said output brake comprising a stationary storage drum which has thread supplied thereto and stored thereon in windings and from which said thread is drawn off discontinuously and overhead into a shed, said storage drum having a rotationally symmetric brake surface, said output brake including an elastically deformable thread brake element, which said thread brake element is adapted to be pressed against said brake surface and is provided with an outer supporting ring, said supporting ring being closed in the circumferential direction and arranged in a holding member encompassing the storage drum in a contact-free manner, a drive control unit and a displacement drive which is arranged in the holding member and is adapted to be controlled by means of said drive control unit when the thread feed device and the weaving machine are in operation, said displacement drive acting on the supporting ring and being used for varying the force with which the thread brake element is pressed against the brake surface, the supporting ring of the thread brake element being adapted to be moved in said holding member in the axial direction of the storage drum with a predetermined amount of axial play relative to the brake surface in two opposite directions, said displacement drive comprising at least one push drive for each of said directions of movement of the supporting ring which said push drive is connected to the holding member and operates exclusively parallel to the axis of said storage drum, said push drive acting directly on the supporting ring and being adapted to be used for positioning said supporting ring on a holding-member contact area located opposite thereto in the respective direction of movement, said gripper weaving machine further comprising a presenter gripper and a receiver gripper, which are adapted to be cooperatingly driven, wherein the drive control unit of the output brake is connected to a control device for the presenter gripper and the receiver gripper by means of which the braking effect of the output brake can be varied several times between a minimum and a maximum value in dependence upon the movements of said presenter gripper and said receiver gripper during each picking cycle.

15. A gripper weaving machine comprising at least one thread feed device provided with a controllable output brake, said output brake comprising a stationary storage drum which has thread supplied thereto and stored thereon in windings and from which said thread is drawn off discontinuously and overhead into a shed, said storage drum having a rotationally symmetric brake surface, said output brake including an elastically deformable thread brake element, which said thread brake element is adapted to be pressed against said brake surface and is provided with an outer supporting ring, said supporting ring being closed in the circumferential direction and arranged in a holding member encompassing the storage drum in a contact-free manner, a drive control unit and a displacement drive which is arranged in the holding member and is adapted to be controlled by means of said drive control unit when the thread feed device and the weaving machine are in operation, said displacement drive acting on the supporting ring and being used for varying the force with which the thread brake element is pressed against the brake surface, the supporting ring of the thread brake element being provided with a central portion that is deformable relative to the brake surface axially and elastically in two opposite directions, said supporting ring being supported in the holding member in an axially immovable manner with respect to the holding member, said displacement drive comprising at least one push drive provided on the holding member for each of said axial deformation directions of said central portion, said push drive operating parallel to the axis of the storage drum and acting directly on said deformable central portion, a ring element which is concentric with the axis of the storage drum being supported on said holding member in an axially displaceable manner, said ring element having a pushing end which is in alignment with the central portion and is adapted to be acted upon by said at least one push drive so as to displace said ring element between a release position defined by a first stop of the holding member and a passive position defined by a second stop of the holding member, said central portion being, at said release position, elastically deformed by the pushing end in the axial direction relative to the supporting ring, whereas, at said passive position, the pushing end will at most abut approximately weakly on said central portion, said gripper weaving machine further comprising a presenter gripper and a receiver gripper, which are adapted to be cooperatingly driven, the drive control unit of the output brake being connected to a control device for the presenter gripper and the receiver gripper by means of which the braking effect of the output brake can be varied several times between a minimum and a maximum value in dependence upon the movements of said presenter gripper and said receiver gripper during each picking cycle.

* * * * *

UNITED STATES PATENT AND TRADEMARK OFFICE

CERTIFICATE OF CORRECTION

PATENT NO. : 5 778 943

DATED : July 14, 1998

INVENTOR(S) : Lars Helge Gottfrid THOLANDER

It is certified that error appears in the above-indentified patent and that said Letters Patent is hereby corrected as shown below:

Column 15, line 64; change "the first: to -- said --.

Column 16, line 22; delete "preferably".

Column 18, line 13; delete "preferably".

Signed and Sealed this

Seventeenth Day of November, 1998

Bruce Lehman

*Attest:*

BRUCE LEHMAN

*Attesting Officer*

*Commissioner of Patents and Trademarks*